US005768972A

United States Patent [19]

Christenson et al.

[11] Patent Number: 5,768,972

[45] Date of Patent: Jun. 23, 1998

[54] AIR LOGIC SYSTEM FOR SIDE LOADER

[75] Inventors: Ronald E. Christenson, Parsons, Tenn.; Calvin Brandt, Plymouth; William P. Bartlett, Dodge Center, both of Minn.

[73] Assignee: McNeilus Truck and Manufacturing, Inc., Dodge Center, Minn.

[21] Appl. No.: 667,302

[22] Filed: Jun. 20, 1996

Related U.S. Application Data

[63] Continuation of Ser. No. 374,813, Jan. 19, 1995, abandoned.

[51] Int. Cl.[6] ..... F15B 13/16

[52] U.S. Cl. ..... 91/361; 91/459; 91/170 R; 91/522; 91/523; 92/68; 100/48; 100/233

[58] Field of Search ..... 91/459, 361, 170 R, 91/171, 182, 188, 521, 522, 523, 392, 393, 382, 534; 92/68, 31, 140; 100/48, 99, 233, 271

[56] References Cited

U.S. PATENT DOCUMENTS

| | | | |
|---|---|---|---|
| 3,090,362 | 5/1963 | Rolls | 91/182 X |
| 4,044,914 | 8/1977 | Hopkins et al. | 100/229 A X |
| 4,155,288 | 5/1979 | Glaze | 91/534 X |
| 4,697,468 | 10/1987 | Bergstrand | 92/140 X |
| 4,759,262 | 7/1988 | Hay, II | 92/68 X |
| 4,896,593 | 1/1990 | Slusser | 100/233 X |
| 5,012,722 | 5/1991 | McCormick | 91/361 |
| 5,035,113 | 7/1991 | Simonyi et al. | 91/361 X |
| 5,110,267 | 5/1992 | Giordani | 92/31 X |
| 5,123,339 | 6/1992 | Hetherington | 100/271 X |
| 5,303,641 | 4/1994 | Gallandere | 91/361 X |
| 5,662,021 | 9/1997 | Farmer et al. | 91/361 |

FOREIGN PATENT DOCUMENTS

A10314238 5/1989 European Pat. Off. .

*Primary Examiner*—Hoang Nguyen
*Attorney, Agent, or Firm*—Haugen and Nikolai, P.A.

[57] ABSTRACT

A control and safety system for coordinating movement of multiple hydraulic cylinders to reciprocally rotate a truck-mounted refuse compacting arm. The system includes a logic board controller in communication with a cam and switch arrangement mechanically linked to the rotating arm. Signals from the switches indicate the position of the arm to the logic board which responds by operating directional control valves to regulate movement of the cylinders. A pressure switch is activated to rotate the arm in the opposite direction if the arm is prevented from reaching a limit switch.

17 Claims, 5 Drawing Sheets

AIR LOGIC SYSTEM FOR SIDE LOADER

This is a continuation of application Ser. No. 08/374,813, filed on Jan. 19, 1995 ABN.

BACKGROUND OF THE INVENTION

I. Field of the Invention

This invention relates generally to coordinating control systems and, more particularly, to a system for controlling the movement of fluid-operated actuators and attached mechanical parts to prevent jamming. The invention has application to portable and stationary systems.

II. Discussion of the Prior Art

In its simplest form, a fluid-operated actuator system includes a single actuator linked to a single machine part. This actuator supplies the force needed to move the part. However, a single actuator may not be able to supply the force needed to move an object as desired in all situations. Also, a very large actuator may be cumbersome to work with and difficult to design into a space-limited machine, so a plurality of smaller actuators may be preferred.

The action of multiple actuators addressing a common machine part must be coordinated in order for the mechanized system to work properly. Otherwise, the device may not work as desired, for example, it may jam and even cause severe damage to the fluid-operated components and the parts of the machine. To prevent jamming and mechanical damage, the movement of multiple fluid-operated components must be coordinated.

In a system for moving an object linearly using multiple fluid-operated actuators the control problem may be resolved by one or more fluid directional control valves switched in unison or another predetermined sequence to move the actuators according to a designed operation. Actuators attached to the same side of an object may be connected in parallel to a single valve which directs fluid into and out of these components to move the object. When the components are attached to opposite sides of the same object, the components on one side may be connected via a first valve and the components on the other side may be connected via a second valve, operated such that fluid is directed into components on one side as it is drained out of components on the other side of the object. In these configurations, either a single valve or multiple valves are switched to enable the object of interest to be smoothly moved.

A simple system for rotating an object may have one linear fluid-operated component rotatably attached to a single eccentric on a rotating device, such as a wheel. The component may be extended and retracted to rotate the wheel up to 180°in each direction from a fully retracted position. Multiple fluid-operated components may be attached on opposing sides to rotate the wheel with more force. The total force exerted is equal to the sum of the forces exerted by the individual components.

To rotate a wheel in a specific direction with multiple fluid-operated components addressing the wheel from diverse directions, at the beginning of a power stroke at least one component must be slightly extended to insure that upon further extension the wheel rotates in the desired direction. Of course, if the components attempt to force the wheel in opposite directions the wheel and components may jam.

To prevent jamming and possibly mechanical damage, the present invention provides a system that controls the movement of multiple fluid-operated actuators and forces them past their fully retracted position to rotate a device in each direction. The system detects the location of a rotating object, such as a high force packing device, at certain points along its arc and relays this information to a fluid logic board which coordinates the actions of the actuators.

The system uses a bell crank assembly firmly attached to a rotating packing device and rotatably attached to two fluid-operated cylinders. The cylinders are attached offset from the bell crank center line. In this configuration, a first cylinder can rotate the object past the fully retracted position of a second cylinder as the second cylinder floats. The cylinders extend together to drive the rotating object in a power stroke. In the return stroke, the logic system directs one cylinder to retract and the other to float to return the object in the opposite direction, either after the object reaches maximum rotation indicated by a switch or after an over-pressure switch in the hydraulic system is activated.

It is accordingly a principal object of the invention to provide a logic operated control system.

Another object of the invention is to provide a control system for multiple fluid-operated cylinders.

Yet another object of the invention is to provide a mechanical configuration including a bell crank and multiple fluid-operated cylinders for smoothly rotating an object in a clockwise and a counterclockwise direction past the cylinders fully retracted positions.

A further object of the invention is to provide a logic system for detecting the position of an object and coordinating the movement of multiple fluid-operated cylinders attached to the object.

Still another object of the invention is to provide an air logic system for detecting the position of an object and coordinating the movement of multiple fluid-operated cylinders for moving the object.

Yet still another object of the invention is to provide a logic system for sensing and detecting the position of a rotating object and causing the object to rotate in a clockwise or a counterclockwise direction.

A still further object of the invention is to provide a system for sensing and detecting an over pressure situation and causing the object to rotate in the opposite direction.

Yet a still further object of the invention is to provide an indicating system for generating signals indicative of the position of a rotating arm and an air logic system for determining the actions of multiple fluid-operated cylinders based on the signals from the indicating system, wherein the actions of the multiple fluid-operated cylinders force the rotating arm to rotate smoothly in a clockwise and a counterclockwise direction past the fully retracted positions of the fluid-operated cylinders.

Other objects, features and advantages of the present invention will become apparent to those skilled in the art through familiarity with the discussion of the prior art, summary of the invention, detailed description, claims, and drawings herein.

SUMMARY OF THE INVENTION

The foregoing objects, features and advantages of the present invention are attained by providing a control and safety system including a controller or logic board in communication with switches which indicate the position of a moving object. The logic board receives signals from the switches and responds by sending output signals to valves connected to fluid-operated cylinders which rotate the object.

One embodiment of the system has been built for a truck-mounted refuse compactor. Of course, the system could be adapted for use on any machine of a class requiring coordinated movement of an object by fluid-operated actuators. For example, the invention could be used for directing the movement of a sliding gate riding on rails and it is best suited to those situations wherein the coordination and timing of the movement of multiple fluid-operated cylinders are critical. In a system having a reversing rotating object, timing and coordination of the movement of attached components may be critical.

In the specific example of the truck-mounted system of the detailed description, the movable object is a packer arm attached to a rotating shaft. The arm rotates back and forth in a plane parallel with the road and is located just behind the cab and ahead of the box into which refuse is packed. In operation, refuse is put into the top of the box near the rotating arm and the arm is forced in one direction, such as clockwise, past 90°from a center position and then returned in the opposite direction, counterclockwise, past 90°from the center position. Thus, the arm is reciprocally rotated in an arc greater than 180°. Two double-acting hydraulic cylinders attached to a bell crank provide a power stroke in each direction.

In the detailed embodiment, the location of the rotating arm is detected by switches operated by a cam mechanically linked to the packer arm for rotation. The switches are stationary cam-operated pneumatic switches which direct air flow or pressure to an air logic board.

The logic board is an arrangement of pneumatically-operated valves in communication with pneumatically-operated hydraulic directional control valves. Thus, the logic board determines the position of the directional control valves to activate the cylinders. This directs fluid to extend, retract or float the hydraulic cylinders. The same result could be achieved by replacing the cam-operated pneumatic switches and air logic board with electrical switches and a micro-controller.

The system in the refuse truck example uses six switches to indicate the position of the packing arm. The switches are set up in two groups of three with one group indicating the position of the arm during clockwise rotation and the other group indicating the position of the arm during counterclockwise rotation. Of course, the switches indicate not only the position of the arm but also the piston position of the hydraulic cylinders and cam mechanically linked to the arm.

While the detailed embodiment uses hydraulic devices, the fluid-operated components or cylinders may be pneumatic and the type, size and number of components will vary with the force needed to move the object of interest. In the refuse truck example, the fluid-operated components are two hydraulic cylinders rotatably attached to the bell crank from opposing sides of the truck box. The bell crank is firmly attached to the top of the rotating arm assembly, such that rotating the bell crank rotates the arm. The hydraulic cylinders are attached to the bell crank equidistant from a centerline, such that each cylinder is slightly extended when the arm is in the center position. One hydraulic cylinder is retracted to pull the arm through the center position and past the second hydraulic cylinder's fully retracted position while the second hydraulic cylinder floats. The second hydraulic cylinder is then extended to push the first cylinder past its fully retracted position while the first cylinder floats. To force the rotating arm to a maximum position in either direction both cylinders are extended. Coordination of hydraulic cylinder movement is controlled by the logic board.

In operation, the arm is rotated to a maximum counterclockwise or clockwise position as both cylinders extend, indicated by a switch contacted by the cam. This event signals the logic board to reverse arm rotation by directing the proper hydraulic cylinder to retract and the other to float. The retracting cylinder pulls the arm past its midway point and the floating cylinder past its fully retracted position so that it again begins to extend. A first switch on one side is then activated and the logic board directs the floating hydraulic cylinder to extend and the retracting cylinder to float. The extending cylinder pushes the rotating arm past the fully retracted position of the floating cylinder. A second switch is then triggered and the floating cylinder is directed to extend. Thus, both cylinders extend simultaneously to rotate the arm with maximum packing power. The arm continues to rotate in one direction until the cam activates a third switch or a high pressure situation is detected. These situations indicate the arm has reached a maximum position, or has been stopped by refuse from reaching the third switch, and must return in the other direction. The cycle repeats until all refuse is packed and rotation of the arm is halted.

The present invention directs the fluid-operated components to act in unison, without jamming, for smoothly reciprocating the arm. If the maximum positions cannot be attained, possibly due to refuse stopping the arm, then a high pressure or over-pressure condition activates an hydraulic pressure switch which sends an over-ride signal to the logic board to reverse the arm's direction and continue through the cycle.

DETAILED DESCRIPTION

Figure 1:
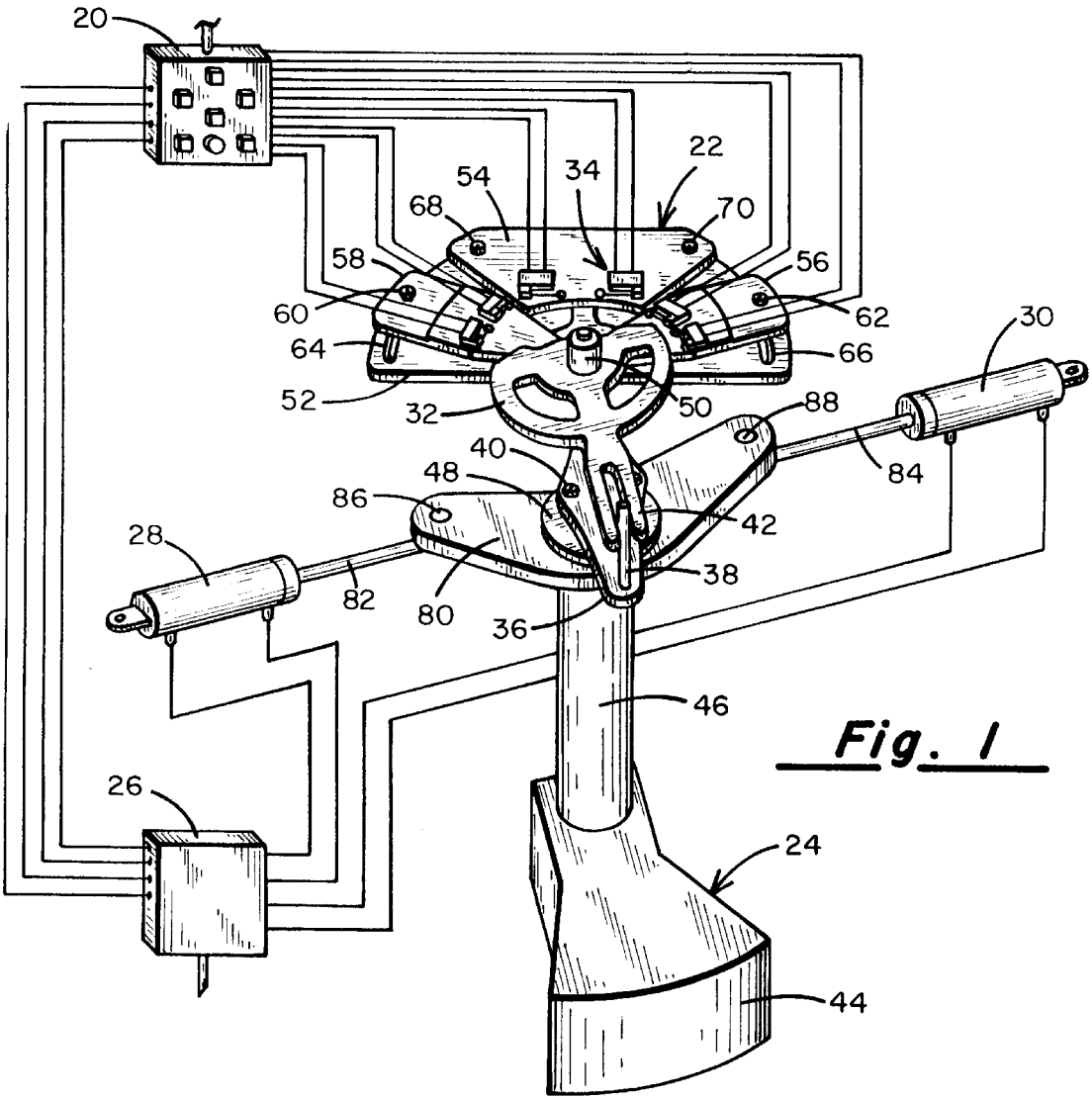
FIG. 1 is a schematic perspective view of a rotating object and a control system for practicing the concepts of the present invention.
Figure 4:
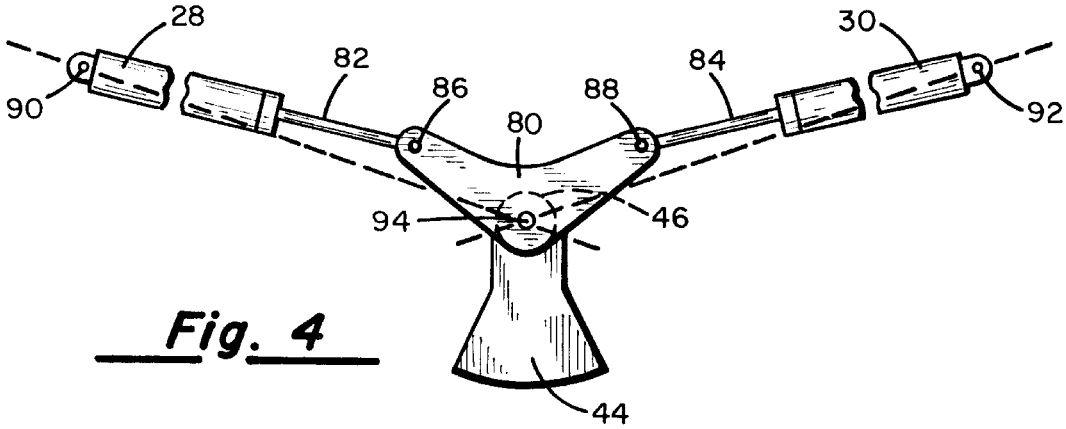
FIG. 4 is a top plan schematic view of a bell crank and rotating packing arm in the center position.

As shown in FIG. 1, the control and safety system of the detailed embodiment includes a logic board 20 connected to a switch system, indicated generally by the numeral 22. The logic board 20 receives signals from the switch system 22 and sends output signals to fluid-operated directional control valves 26. The directional control valves 26 direct fluid flow into and out of double-acting cylinders 28 and 30 to rotate an arm 44. A cam 32 is mechanically linked to the arm 44 and a shaft 46 for rotation, such that rotating the shaft 46 turns the cam 32 and triggers the switches, indicated generally by 34.

Figure 3:
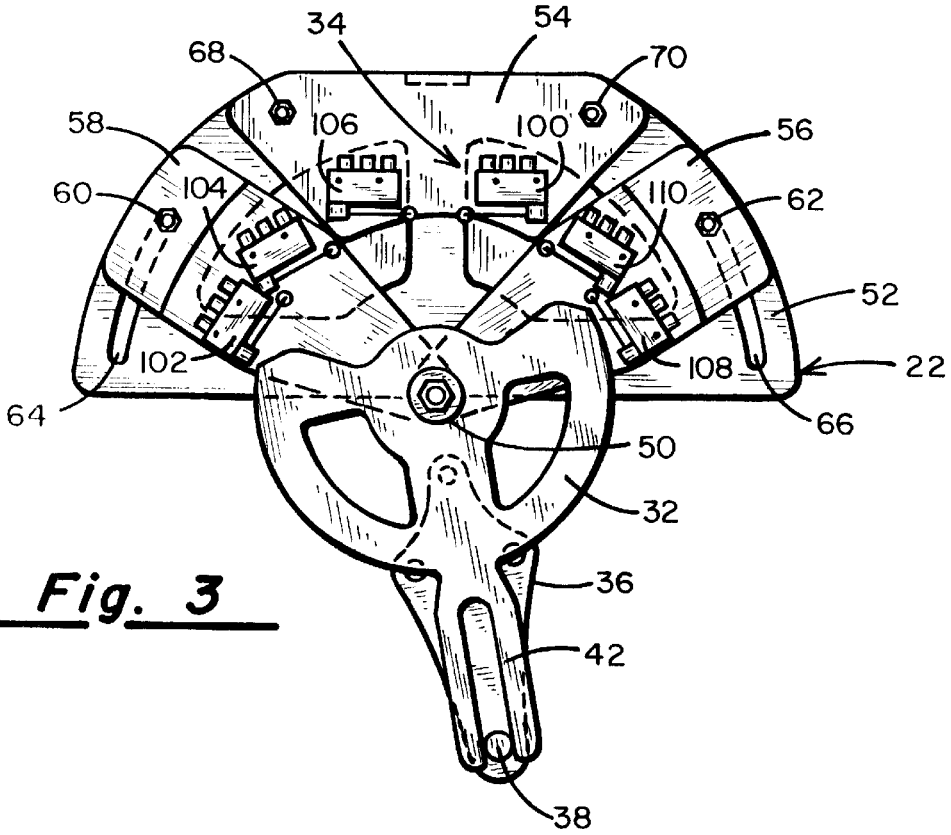
FIG. 3 is a top plan view of the cam and switch arrangement of FIG. 1 showing their relative positions and also showing the mechanical linkage for operating the cam.
Figure 2:
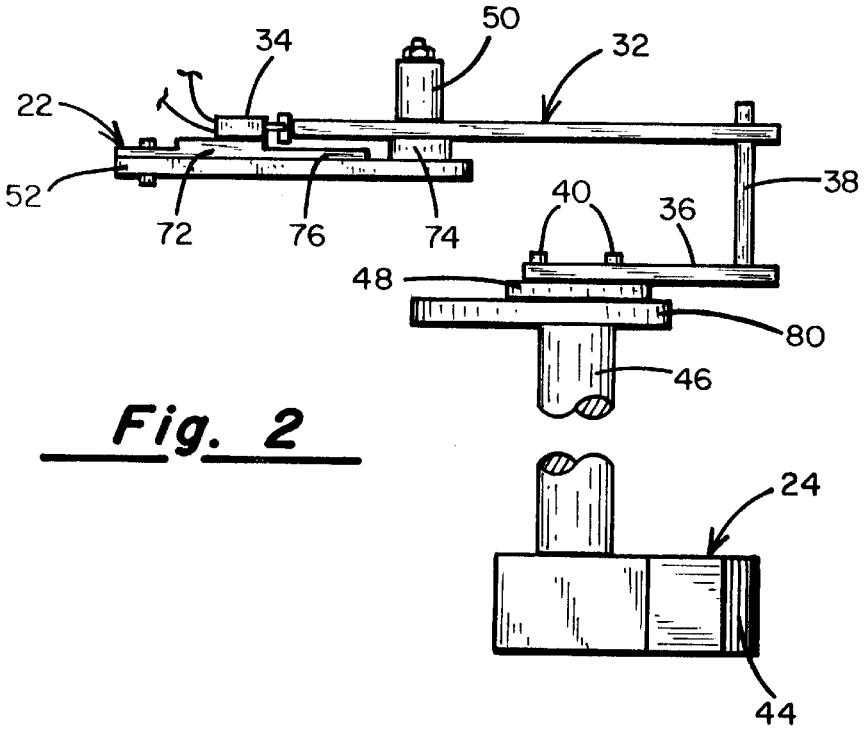
FIG. 2 is a side elevation view of the mechanical linkage between the rotating object and the cam and switch arrangement of FIG. 1.

As shown in FIGS. 1, 2, and 3, the mechanical linkage connecting the arm 44 and cam 32 includes a support platform 36 and a linkage rod 38 securely attached to the support platform 36, such as by welding or force-fitting the rod 38 into a hole in the platform 36. The other end of the rod 38 is slidably accommodated between the prongs of a forked portion 42 of cam 32. The support platform 36 is attached, such as with bolts 40, to a top plate 48 welded on the shaft 46 which, in turn, may be rotatably connected to a primary platform (not shown). The arm 44 is firmly attached, such as by welding, to the rotating shaft 46. The arm 44 and support platform 36 rotate about the axis of the shaft 46 and turn the cam 32 about its central axis 50 through movement of the rod 38 between the prongs of the forked portion 42.

The cam 32 is rotatably mounted to the switch system 22 at the cam's central axis 50. The switch system 22 is securely mounted to a secondary platform (not shown) that does not move in relation to the axis of the shaft 46. Thus, as the shaft 46 and support platform 36 rotate, the rod 38 moves between the prongs of the forked portion 42 to rotate the cam 32 about its central axis 50 to trigger switches 34.

The switch system 22 includes a central plate 54 and two radially adjustable side plates 56 and 58 mounted on a base plate 52. In the embodiment of the refuse truck example, the center plate 54 and each of the side plates 56 and 58 carry two switches. Side plates 56 and 58 are adjustably mounted at one end to the base plate 52 with bolts 60 and 62 through slots 64 and 66 in the base plate 52. The inner end of each side plate 56 and 58 is mounted for rotation about the central axis 50 of the cam 32. Thus, the side plates 56 and 58 can be adjusted to position the switches 34 as needed in relation to the cam 32. The switches 34 may be mounted on each side plate 56 and 58 with screws. The center plate 54 is mounted to the base plate 52 with bolts 68 and 70 at one end and welded at the other end. The two switches mounted on the center plate 54 are positioned as needed before being fixed, such as with screws, to the center plate 54. The six mounted switches 34 describe a semicircle addressed by the cam 32 as it reciprocates.

As shown in FIG. 2, the switches 34 are mounted on a raised portion 72 of the side plates 56 and 58. The cam 32 is rotatably mounted to the base plate 52 about its central axis 50 with a spacer 74 therebetween. This raises the cam 32 above the lower stepped portions 76 of the side plates 56 and 58 and up to the level of the cam operated switches 34. Movement of the cam 32 triggers the switches 34, indicating the position of the arm 44.

In the refuse truck example, a bell crank 80 is attached to shaft 46 and mechanically linked to cylinders 28 and 30. The cylinders 28 and 30 are attached to opposite sides of the truck box in the plane of the bell crank 80. As shown in FIGS. 1 and 4–10, first and second cylinder rods 82 and 84 extend from cylinders 28 and 30 to the bell crank 80 and are rotatably connected at 86 and 88, respectively. First and second cylinder rods 82 and 84 extend and retract from their respective cylinders to rotate the bell crank 80 which turns the shaft 46 and arm 44.

FIGS. 4–10 show the operation sequence of the packer arm 44 in the refuse truck example. As indicated, cylinder rods 82 and 84 are connected to the crank 80 at first and second points 86 and 88, and cylinders 28 and 30 are connected to members at opposite sides of the refuse box at points 90 and 92. Bell crank 80 may be "boomerang" shaped and cylinder rods 82 and 84 are attached such that each is slightly extended when the arm 44 is in the center position, shown in FIG. 4. In this position, first and second points 86 and 88 are above the broken lines connecting points 90 and 92 to the central axis 94 of shaft 46. Thus, bell crank 80 and arm 44 must rotate to one side of the center position to fully retract either cylinder 28 or 30.

The position of the arm 44, FIG. 1, is detected by the cam 32 and switch system 22. The switches 34 are positioned on the center plate 54 and side plates 56 and 58 to indicate the position of the arm 44 and cylinders 28 and 30 at critical points of the cycle. Movement of the cylinder rods 82 and 84 is coordinated by the air logic board 20 for smooth rotation of the arm 44 from a maximum clockwise or counterclockwise position through the central position. In the preferred embodiment of the refuse truck example, these actions are coordinated by detecting and indicating the position of the rotating arm 44 at six different points; three positions on each side of the center position.

In operation, retracting one cylinder 28 or 30 rotates arm 44 past the center position and pulls the other floating cylinder 28 or 30 past its fully retracted position. The retracting cylinder 28 or 30 then floats and the floating cylinder 28 or 30 extends. This pulls the now floating cylinder 28 or 30 past its fully retracted position. Both cylinders 28 and 30 extend to push the arm 44 in a power stroke rotating the bell crank 80 and arm 44 to, for example, a maximum counterclockwise position, FIG. 5. At this point, switch 100 (FIG. 3) is depressed by cam 32 and signals logic board 20 which responds by directing cylinder 30 to retract and cylinder 28 to float. Arm 44 rotates clockwise past the full retraction point of cylinder 28, shown in dashed lines in FIG. 6. At the position shown in FIG. 6, cylinder 30 is not fully retracted when cam 32 depresses switch 102 (FIG. 3).

Switch 102 signals logic board 20 which directs cylinder 30 to float and cylinder 28 to extend. This pushes arm 44 in a clockwise direction and pulls cylinder 30 past its fully retracted position to a slightly extended position. At this position, shown in FIG. 7, switch 104 is depressed. This directs cylinder 30 to extend. Thus, both cylinders 28 and 30 extend in a dual power stroke to rotate arm 44 in a clockwise direction toward its maximum clockwise position.

Figure 5:
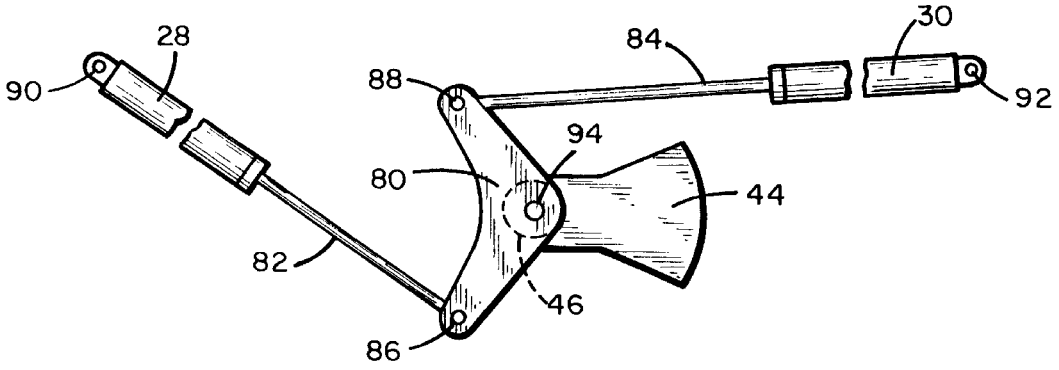
FIG. 5 is a top plan schematic view of the bell crank and rotating packing arm in the maximum counterclockwise position.
Figure 8:
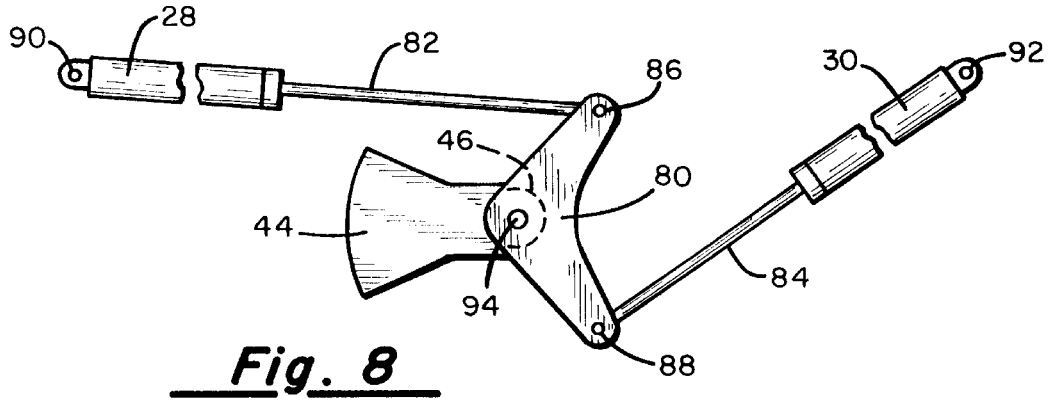
FIG. 8 is a top plan schematic view of the bell crank and rotating packing arm in the maximum clockwise position.
Figure 9:
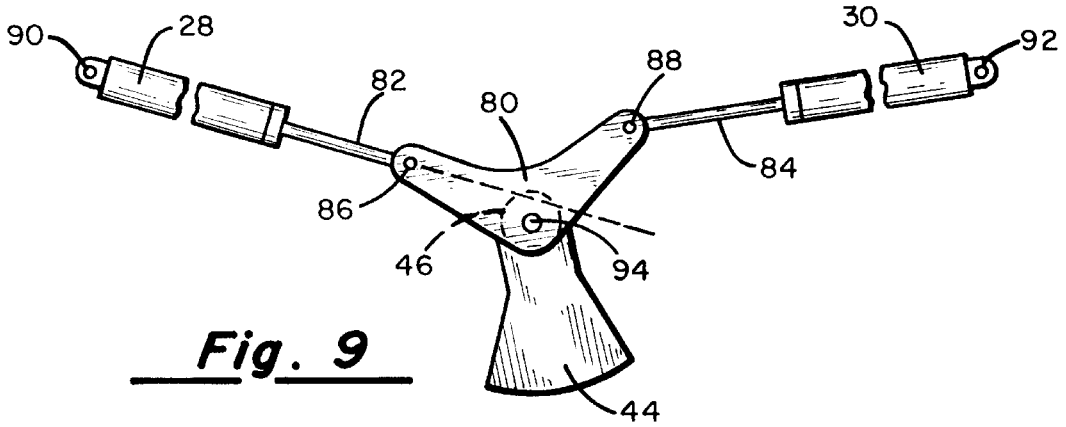
FIG. 9 is a top plan schematic view of the bell crank and rotating packing arm just past the center position and rotating counterclockwise.
Figure 10:
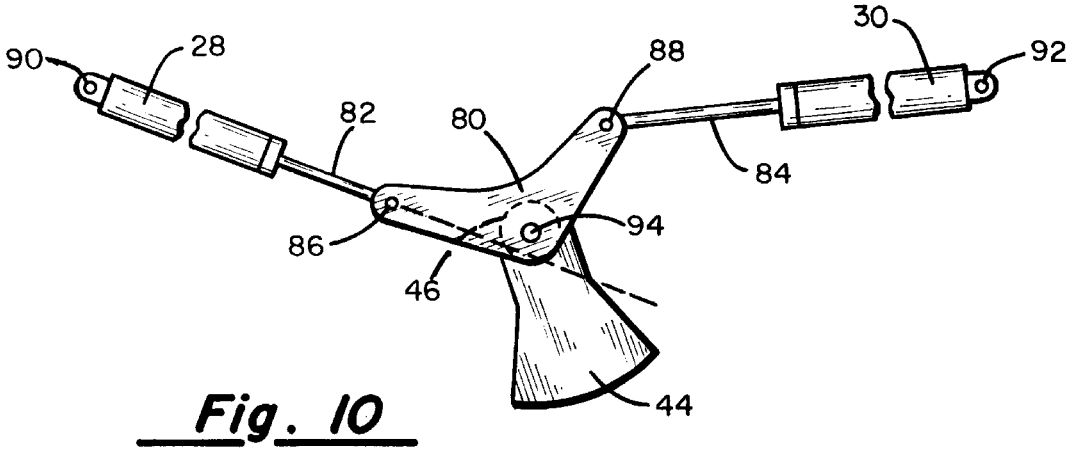
FIG. 10 is a top plan schematic view of the bell crank and rotating packing arm at the point where the fluid operated cylinders push counterclockwise in a power stroke.

At the maximum clockwise position, shown in FIG. 8, cam 32 triggers switch 106 (FIG. 3). Switch 106 signals logic board 20 which directs cylinder 28 to retract and cylinder 30 to float. Cylinder 28 pulls the arm 44 counterclockwise which forces cylinder 30 past its fully retracted position. Cylinder 28 retracts until the arm 44 has been pulled past the center position. At this position, shown in FIG. 9, cam 32 depresses switch 108 which, in turn, signals logic board 20 to direct cylinder 28 to float and cylinder 30 to extend. This pushes arm 44 counterclockwise and pulls cylinder 28 past its fully retracted position to a slightly extended position. At this position, shown in FIG. 10, cam 32 depresses switch 110 which signals logic board 20, which, in turn, directs cylinder 28 to extend with cylinder 30 to push arm 44 to its maximum counterclockwise position in a dual-cylinder power stroke. The position of the bell crank 80 and arm 44 is as shown in FIG. 5 and the cycle repeats.

Figure 11:
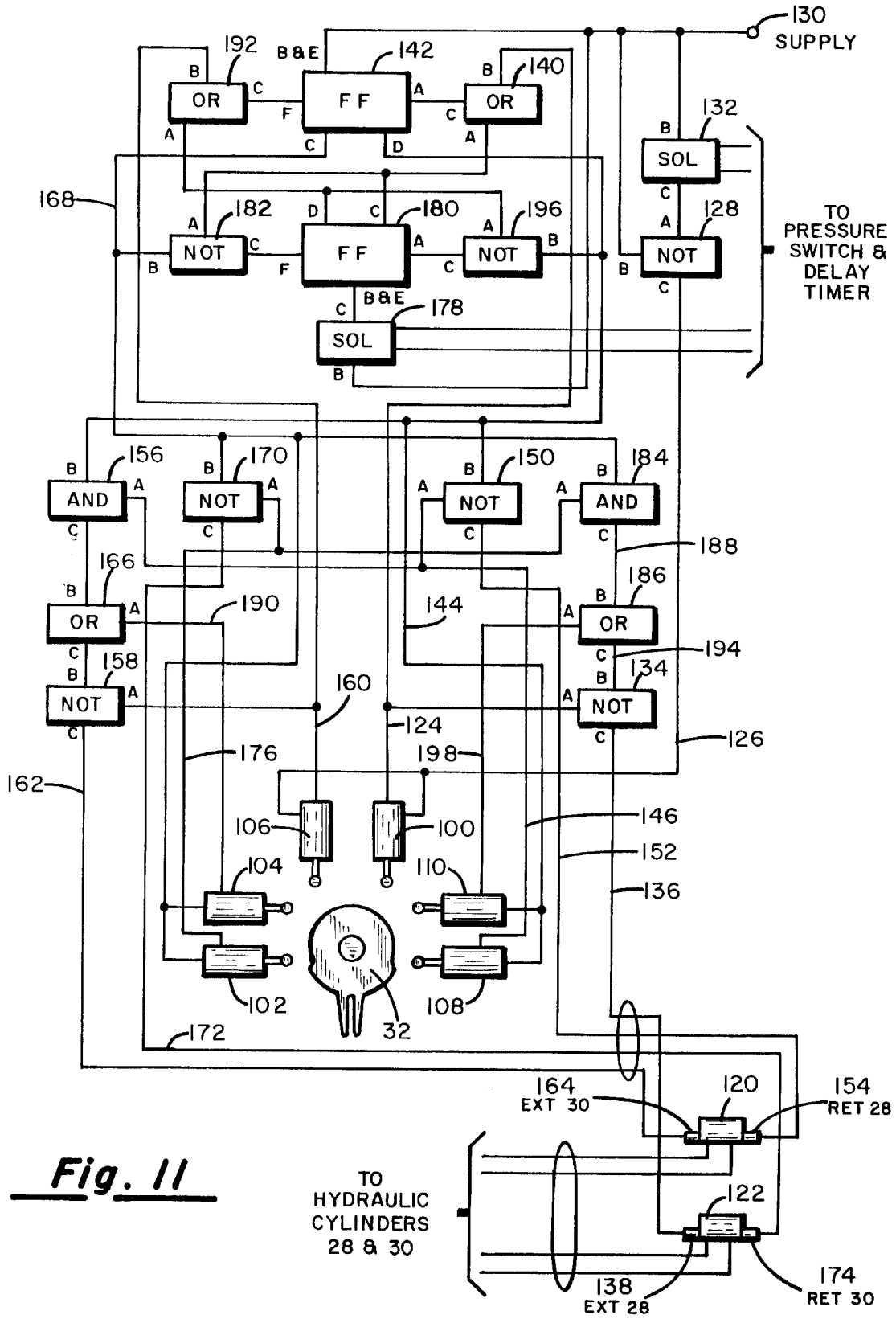
FIG. 11 is a schematic layout of the air logic board and hydraulic cylinder valves.

The components on the air logic board 20 are pneumatically operated, moving-part, logic control devices connected together as shown in FIG. 11 to coordinate the operation of cylinders 28 and 30 in response to signals received from switches 34. They include, inter alia, AND, OR, and NOT logic elements and FLIP-FLOP memory elements.

The operation of these devices is well known. Thus, an AND element combines two air signal, inputs, A and B, such that both need to be on to turn on the output C. If either A or B is off, then C is off. The logic table is as follows:

| AND | A | B | C |
|---|---|---|---|
| 1 | off | off | off |
| 2 | off | on | off |
| 3 | on | off | off |
| 4 | on | on | on |

Likewise, an OR element combines two air signal inputs, A and B, such that if either or both are on, output C is on. Only when both A and B are off is C off. The logic table is as follows:

| OR | A | B | C |
|---|---|---|---|
| 1 | off | off | off |
| 2 | off | on | on |
| 3 | on | off | on |
| 4 | on | on | on |

Also, a NOT element combines two air signal inputs such that input B must be on and input A must be off for output C to be on. The logic table for this function is as follows:

| NOT | A | B | C |
|---|---|---|---|
| 1 | off | off | off |
| 2 | off | on | on |
| 3 | on | off | off |
| 4 | on | on | off |

Finally, FLIP-FLOP elements convert momentary signals received at set and reset inputs into maintained corresponding outputs. A FLIP-FLOP has a set input labeled A, a reset input F, a set output C, a reset output D and two supply inputs labeled B and E. A set signal received at A turns C on and D off. Similarly, a reset signal received at F turns D on and C off. If the set or reset signals are maintained, later received signals of equal pressure to opposite inputs will not alter the output condition of the FLIP-FLOP. A logic table for the FLIP-FLOP is as follows:

| FLIP-FLOP | A | F | C | D |
|---|---|---|---|---|
| 1 | off | off | previous state | |
| 2 | off | on | off | on |
| 3 | on | off | on | off |
| 4 | on | on | first received | |

The air logic components are connected together as shown in FIG. 11 to supply signals to pneumatically operated hydraulic directional control valves 120 and 122 in response to signals received from switches 34, more specifically numbered 100, 102, 104, 106, 108 and 110. Valves 120 and 122 control the direction of hydraulic fluid to and from cylinders 28 and 30 for smoothly rotating the arm 44 clockwise and counter-clockwise.

Rotation of the arm 44 may be described from one maximum position to the other so that in operation, at the maximum counter-clockwise position shown in FIG. 5, switch 100 is pushed or depressed by cam 32 and air is directed to line 124 from air supply line 130 through NOT gate element 128 and line 126. Output C of NOT 128 is on since air is supplied to input B from air supply line 130 and A is off as ported through solenoid valve SOL 132. Air in line 124 supplies pressure to input A of NOT 134 which turns off NOT 134 and exhausts air through line 136 from the extend input 138 for cylinder 28 on valve 122. This takes cylinder 28 out of the extend mode. Line 124 also directs air to input B of OR 140 which turns output C on and supplies air to input A of FLIP-FLOP 142. This turns FLIP-FLOP output C on and D off. Air is exhausted or bled through output D and line 144, through switch 108 and line 146 from input A of NOT 150. However, output C of NOT 150 remains off since input B is off or exhausted through FLIP-FLOP output D. The retract input 154 for cylinder 28 on valve 120 remains off with air exhausted through line 152 and NOT 150. Thus, cylinder 28 floats.

Cylinder 30 is switched from extending to retracting when switch 100 is pushed. Output C of AND 156 is shut off when air is exhausted from input A through line 146 and switch 108 and from input B through FLIP-FLOP output D. NOT 158 has input B exhausted through output C of OR 166. This shuts off output C of NOT 158 and air is exhausted through line 162 from the extend input 164 for cylinder 30 on valve 120. This takes cylinder 30 out of the extend mode. To put cylinder 30 into the retract mode, air is directed from output C on FLIP-FLOP 142 through line 168 and NOT 170 to line 172 and the retract input 174 for cylinder 30 on valve 122. Cylinder 30 retracts and cylinder 28 floats to rotate arm 44 clockwise from the maximum counter-clockwise position.

Depressing switch 100 also presets the system for counter-clockwise rotation to occur if the pressure switch is activated for a predetermined time, due to such things as an over-pressure situation, during clockwise rotation. Solenoid (SOL) 178 is not activated when the pressure switch (not shown) is inactive. Air supply inputs B and E of FLIP-FLOP 180 are exhausted through port C of SOL 178 and no air is supplied to FLIP-FLOP output C or D. In turn, input A of NOT 182 is off and B is on so output C is on and air is supplied to input F of FLIP-FLOP 180. This resets FLIP-FLOP 180. If the pressure switch (not shown) is activated and SOL 178 is turned on, air flows from air supply line 130 to FLIP-FLOP inputs B and E. Output D supplies air to input F of FLIP-FLOP 142 and, as described below, clockwise rotation is stopped and arm 44 is returned in a counter-clockwise rotation. The following table shows switch and valve input status after switch 100 is pushed:

| Switch | 100 | 102 | 104 | 106 | 108 | 110 |
|---|---|---|---|---|---|---|
| Status | on | off | off | off | on | on |

(on = depressed)

| Valve input | | Status | Cylinder Status |
|---|---|---|---|
| Ext | 138 | off | Cylinder 28 Floats |
| Ret | 154 | off | |
| Ext | 164 | off | Cylinder 30 Retracts |
| Ret | 174 | on | |

Figure 6:
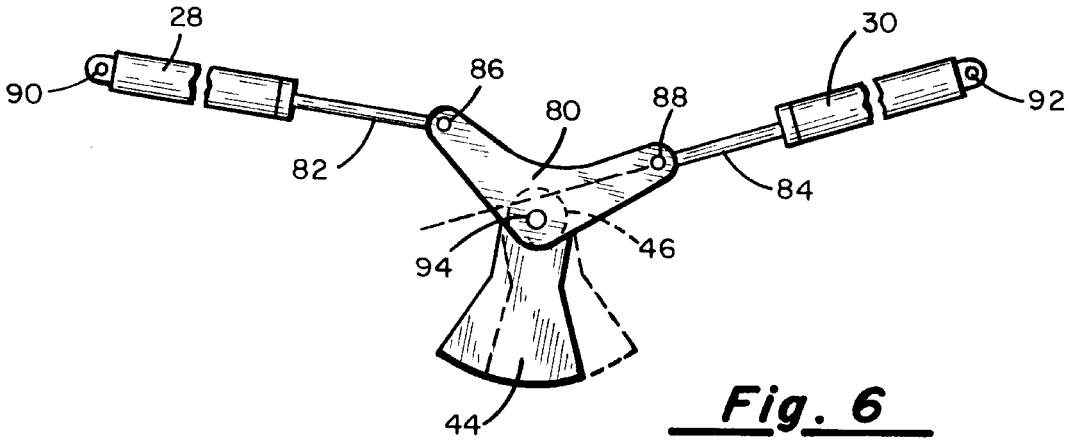
FIG. 6 is a top plan schematic view of the bell crank and rotating packing arm just past the center position and rotating clockwise.

Arm 44 rotates clockwise with cylinder 30 retracting and cylinder 28 floating until switch 102 is depressed at the position shown in FIG. 6. At this time, cylinder 30 is put into the float mode and cylinder 28 is extended. Switch 102 is supplied air from output C of FLIP-FLOP 142 through line 168. Switch 102, pushed by cam 32, directs air through line 176 to input A of NOT 170. This shuts off output C of NOT 170 and exhausts air through line 172 from retract input 174 for cylinder 30 on valve 122. The extend input 164 for cylinder 30 is exhausted through output C of NOT 158 which remains off and cylinder 30 floats. Input A of AND 184 is pressurized through line 176 and input B is pressurized from output C of FLIP-FLOP 142. In turn, output C of AND 184 is on and output C of OR 186 is on. This provides air to input B of NOT 134. Input A of NOT 134 is exhausted through switch 100 so output C is on and air is supplied through line 136 to the extend input 138 for cylinder 28 on valve 122. Retract input 154 for cylinder 120 is exhausted through NOT 150. This extends cylinder 28 while cylinder 30 floats and the arm 44 rotates further clockwise, past the fully retracted position of cylinder 30. The arm 44 rotates clockwise in this manner until switch 104 is pushed. The following table shows switch and valve input status after switch 102 is pushed:

| Switch | 100 | 102 | 104 | 106 | 108 | 110 |
|---|---|---|---|---|---|---|
| Status | off | on | off | off | off | off |

(on = depressed)

| Valve input | | Status | Cylinder Status |
|---|---|---|---|
| Ext | 138 | on | Cylinder 28 Extends |
| Ret | 154 | off | |
| Ext | 164 | off | Cylinder 30 Floats |
| Ret | 174 | off | |

Figure 7:
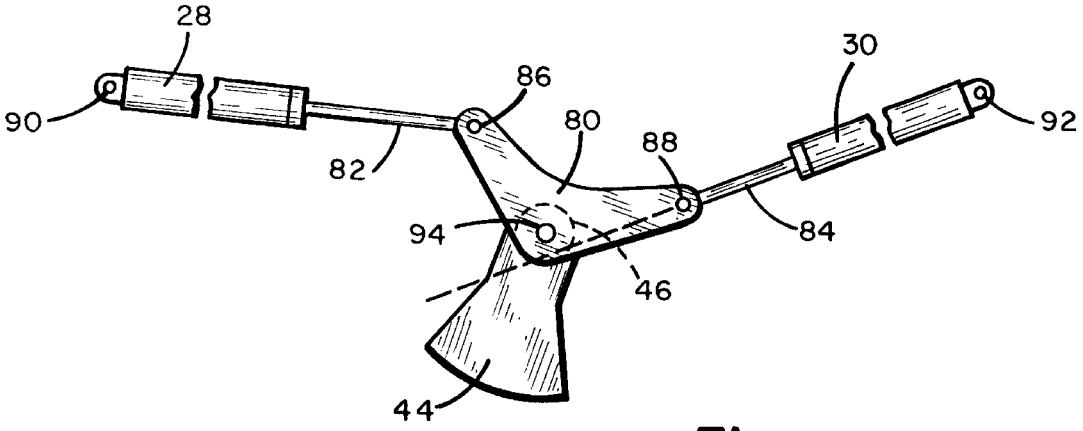
FIG. 7 is a top plan schematic view of the bell crank and rotating packing arm at the point where the fluid operated cylinders push clockwise in a power stroke.

When switch 104 is depressed, arm 44 is as shown in FIG. 7 and cylinder 30 is directed to extend along with cylinder 28 to rotate arm 44 clockwise in a dual power stroke for packing refuse. More specifically, air from output C of FLIP-FLOP 142 is directed through switch 104 and line 190 to input A of OR 166. Output C of OR 166 pressurizes input B of NOT 158. Input A of NOT 158 is exhausted through switch 106 so output C provides air through line 162 to the extend input 164 for cylinder 30 on valve 120. The retract input 174 remains exhausted through NOT 170. This extends cylinder 30 with cylinder 28 to rotate the arm 44 in a clockwise direction until the pressure switch is activated or the arm 44 reaches a maximum clockwise position, shown in FIG. 8. The following table shows switch and valve input status after switch 104 is pushed:

| Switch | 100 | 102 | 104 | 106 | 108 | 110 |
|---|---|---|---|---|---|---|
| Status | off | on | on | off | off | off |

(on = depressed)

| Valve input | | Status | Cylinder Status |
|---|---|---|---|
| Ext | 138 | on | Cylinder 28 Extends |
| Ret | 154 | off | |
| Ext | 164 | on | Cylinder 30 Extends |
| Ret | 174 | off | |

At the maximum clockwise position, shown in FIG. 8, switch 106 is pushed and air from supply line 130 is directed through line 160 to input A of NOT 158. Line 162 and extend input 164 of valve 120 are exhausted, which takes cylinder 30 out of the extend mode. Air is directed through line 160 to OR 192 and input F of FLIP-FLOP 142 is turned on. Since input A of FLIP-FLOP 142 is off, the FLIP-FLOP changes state and output D is on while output C is off. Air flow is exhausted from input B of NOT 170 so retract input 174 remains off and cylinder 30 floats. Air is also exhausted from switches 102 and 104 through line 168, which, turns input A of AND 184 off through line 176 and shuts output C off, which, turns OR 186 off and NOT 134 off to exhaust air from input 138 of valve 122. Cylinder 28 stops extending. Air is supplied from output D of FLIP-FLOP 142 to input B of NOT 150. Output C of NOT 150 is turned on and supplies air through line 152 to input 154 of valve 120. This retracts cylinder 28 while cylinder 30 floats and arm 44 rotates counter-clockwise.

Pushing switch 106 also prepares the air logic circuitry for rotating the arm 44 clockwise upon activation, for a predetermined time, of the pressure switch. Output C of SOL 178 exhausts air from air supply inputs B and E of FLIP-FLOP 180. Input A of NOT 196 is off and air is directed through line 144 to input B of NOT 196. This turns output C of NOT 196 and input A of FLIP-FLOP 180 on and prepares FLIP-FLOP 180 to supply air from output C to input A of FLIP-FLOP 142 upon activation of the pressure switch for a predetermined time. Supplying air to input A of FLIP-FLOP 142 causes the arm to rotate clockwise. The following table shows switch and valve input status after switch 106 is pushed:

| Switch | 100 | 102 | 104 | 106 | 108 | 110 |
|---|---|---|---|---|---|---|
| Status | off | on | on | on | off | off |

(on = depressed)

| Valve input | | Status | Cylinder Status |
|---|---|---|---|
| Ext | 138 | off | Cylinder 28 Retracts |
| Ret | 154 | on | |
| Ext | 164 | off | Cylinder 30 Floats |
| Ret | 174 | off | |

Cylinder 28 retracts and cylinder 30 floats until cam 32 pushes switch 108. At this position, shown in FIG. 9, cylinder 28 is put into the float mode and cylinder 30 is put into the extend mode. Air is directed from output D of FLIP-FLOP 142 through line 144 and switch 108 to line 146 and input A of NOT 150. This turns off output C of NOT 150 and exhausts input 154 of valve 120 which, in turn, takes cylinder 28 out of the retract mode. Input A of AND 156 is turned on and input B is on with air supplied through line 144 and output D of FLIP-FLOP 142. This turns on output C which turns on output C of OR gate 166. Output C of NOT gate 158 is turned on and air is directed through line 162 to input 164 of valve 120. This extends cylinder 30. The following table shows switch and valve input status after switch 108 is pushed:

| Switch | 100 | 102 | 104 | 106 | 108 | 110 |
|---|---|---|---|---|---|---|
| Status | off | off | off | off | on | off |

(on = depressed)

| Valve input | | Status | Cylinder Status |
|---|---|---|---|
| Ext | 138 | off | Cylinder 28 Floats |
| Ret | 154 | off | |
| Ext | 164 | on | Cylinder 30 Extends |
| Ret | 174 | off | |

The arm 44 continues to rotate counter-clockwise, with cylinder 28 floating, until switch 110 is depressed. At this position, shown in FIG. 10, cylinder 28 is put into the extend mode and both cylinders push the arm 44 in a counterclockwise power stroke. Switch 110 directs air from line 144 through line 198 to input A of OR 186. Output C of OR 186 forces air through line 184 to input B of NOT 134. Output C of NOT 134 turns on and air is supplied through line 136 to extend input 138 of valve 122. This puts cylinder 28 into the extend mode. Cylinders 28 and 30 extend until the pressure switch is activated for a predetermined time or the maximum counter-clockwise position, shown in FIG. 5, is achieved. Switch 100 is then depressed and the cycle is repeated. The following table shows switch and valve input status after switch 110 is pushed and the arm 44 rotates in the counter-clockwise power stroke:

| Switch | 100 | 102 | 104 | 106 | 108 | 110 |
|---|---|---|---|---|---|---|
| Status | off | off | off | off | on | on |

(on = depressed)

| Valve input | | Status | Cylinder Status |
|---|---|---|---|
| Ext | 138 | on | Cylinder 28 Extends |
| Ret | 154 | off | |
| Ext | 164 | on | Cylinder 30 Extends |
| Ret | 174 | off | |

An important aspect of the invention is the ability of the air logic system to sense stalled operation of the packer arm 44. Accordingly, if arm 44 cannot attain the maximum clockwise or counter-clockwise position, due to something such as jammed refuse preventing rotation, the high pressure or over-pressure switch is activated to over-ride cyclic operation and reverse the direction of motion of the arm 44. In one embodiment, the pressure switch is activated at approximately 2100 psi. SOL 132 is activated immediately to direct air from air supply line 130 to input A of NOT 128, shutting off output C and cutting off air supply to maximum limit switches 100 and 106. Activation of the pressure switch also sends a signal to a delay timer (not shown) which must see the high pressure indication for a predetermined time period, such as at least 5 seconds in the preferred embodiment, before an over-riding reverse signal is sent to the air logic board. After the predetermined time period, SOL 178 is activated and air is directed from air supply line 130 to air supply inputs B and E of FLIP-FLOP 180. Depending upon which way FLIP-FLOP 180 is preset, air is passed to input A or input F of FLIP-FLOP 142 to change the direction of the rotating arm 44. For example, if FLIP-FLOP 180 is preset such that output C is on when air is supplied to input B or E, then output C will direct a signal through OR 140 to input A of FLIP-FLOP 142 and arm 44 will rotate in a clockwise direction. Conversely, if output D of FLIP-FLOP 180 is turned on then air will be supplied to OR 192 and input F of FLIP-FLOP 142 and arm 44 will rotate in a counter-clockwise direction.

This invention has been described herein in considerable detail in order to comply with the Patents Statutes and to provide those skilled in the art with the information needed to apply the novel principles and to construct and use such specialized components as are required. However, it is to be understood that the invention can be carried out by specifically different equipment and devices, and that various modifications, both as to the equipment and operating procedures, can be accomplished without departing from the scope of the invention.

What is claimed is:

1. A control system for controlling the operation of a mechanical compacting system, comprising;

(a) a reversing revolving force transmitting mechanical compacting device of interest;

(b) a plurality of mechanized reversing linear actuators mechanically linked to reversibly angularly displace said mechanical compacting device of interest;

(c) fluid operated control logic means in communication with said plurality of reversing linear actuators for controlling the operation of said plurality of reversing linear actuators through an operating sequence; and (d) position indicator means adjustably fixed to said mechanical compacting device of interest and in communication with said fluid operated logic means for indicating the position of said plurality of reversing linear actuators, including intermediate and extreme positions, and providing control signals to said fluid operated logic means.

2. The system of claim 1, wherein said plurality of reversing linear actuators includes first and second actuators disposed in diverse relation to said mechanical device of interest and to each other such that said operation of one of said actuators moves the other of said actuators from partial extension through full retraction and back to partial extension.

3. The system of claim 2, wherein said first and said second actuators can be extended together in a combined power stroke.

4. The system of claim 1, wherein said plurality of mechanized reversing linear actuators are fluid-operated cylinders and wherein said logic means comprises pneumatic valves connected to said indicator means and also to directional control valves for operating said plurality of fluid-operated cylinders.

5. The system of claim 4, wherein said position indicator means comprises a cam and switch means, said switch means being adjustably fixed to said reversing revolving mechanical compacting device of interest and wherein said cam operates said switch means as said mechanical compacting device of interest moves to indicate the position of said mechanical compacting device of interest.

6. The system of claim 1, wherein said reversing linear actuators are fluid-operated cylinders and said indicator means comprises stationary switch means and a cam means, said cam means being mechanically linked to said mechanical device of interest and wherein said switch means is operated by said cam means as said mechanical device of interest rotates.

7. The system of claim 6, wherein said switch means comprises a plurality of pneumatic switches attached to a stationary platform and said cam means rotates with said mechanical device of interest to operate said plurality of pneumatic switches.

8. The control system as in claim 6, further comprising an over-pressure sensing means for sensing an over-pressure condition in fluid operating said fluid-operated actuators and sequence interruption means for changing the order of said sequence of events based on signals received from said over-pressure sensing means.

9. A mechanical control system, comprising:

(a) a reciprocally rotating mechanical compacting device;

(b) a cam linked to rotate with said reciprocally rotating mechanical device;

(c) a plurality of switch means attached in relation to said cam and operated by contacting said cam as the mechanical device rotates thereby indicating the position of said rotating mechanical device including extreme and intermediate positions;

(d) a bell crank mechanically linked to rotate said mechanical device;

(e) a plurality of hydraulic cylinders mechanically linked to and addressing said bell crank from substantially diverse directions;

(f) sensing means for sensing an operating impasse of said mechanical device in its reciprocal operation; and (g) logic means for directing said plurality of hydraulic cylinders through a desired sequence of movements, said logic means including means to reverse the direction of rotation of said mechanical device should the operating impasse of said device occur, said logic means receiving signals from said switch means.

10. The system as in claim 9, wherein said plurality of hydraulic cylinders comprises first and second hydraulic cylinders attached to said bell crank in a manner such that extension and retraction of one moves the other through full retraction during said desired sequence of movements and wherein said first and said second actuators can be extended together in a combined power stroke in either rotational direction.

11. The system as in claim 9, wherein said logic means comprises pneumatic logic gates arranged to receive signals from said switch means and responsively operated directional control valves which operate said plurality of hydraulic cylinders to rotate said mechanical device and wherein said switch means comprises a plurality of spaced cam operated pneumatic switches in fixed arrangement on a stationary platform and said cam is fixed to rotate with said mechanical device to thereby sequentially operate said pneumatic switches.

12. The system of claim 9 wherein said sensing means further comprises a high limit fluid pressure switch mean for sensing an over-pressure of hydraulic fluid and means for communicating an over-pressure condition to said logic means.

13. A system for controlling the angular displacement of a prime reversibly revolving compacting mechanism, comprising:

(a) fluid operated linear actuator means for angularly displacing the reversibly revolving compacting mechanism;

(b) indicator means for indicating a plurality of angular positions of the reversible revolving compacting mechanism including extreme and intermediate angular positions and for generating input signals indicative of the position, said indicator means being adjustably fixed to the reversible revolving compacting mechanism;

(c) fluid operated control logic means for receiving said input signals and generating control responses to control said forcing means and thereby the angular displacement of the reversible revolving compacting mechanism;

(d) sensing means for sensing a stalled condition of the reversible rotating compacting mechanism and for generating stall indicating signals pursuant thereto; and (e) fluid operated over-ride means responsive to said stall indicating signals for generating an over-ride response to said linear actuator means to cause said linear actuator means to reverse the direction of the reversible revolving compacting mechanism.

14. The system as in claim 13, wherein the stalled condition is sensed by detecting a high pressure condition in said fluid operated linear actuator means.

15. The system as in claim 14, wherein said sensing means comprises a pressure sensor and a delay timer.

16. The system as in claim 13, wherein said control logic means and said over-ride means are pneumatic elements.

17. The system as in claim 13, wherein said control logic means and said over-ride means comprise shared logic and memory elements.

* * * * *